US009134091B2

(12) United States Patent
Busse et al.

(10) Patent No.: US 9,134,091 B2
(45) Date of Patent: Sep. 15, 2015

(54) TOY LAUNCH APPARATUS WITH MOMENTUM FEATURE

(71) Applicant: Hasbro, Inc., Pawtucket, RI (US)

(72) Inventors: Mark Busse, Providence, RI (US); David Nugent, Newport, RI (US); Robert James Victor, Sunnyside, NY (US)

(73) Assignee: Hasbro, Inc., Pawtucket, RI (US)

( * ) Notice: Subject to any disclaimer, the term of this patent is extended or adjusted under 35 U.S.C. 154(b) by 14 days.

(21) Appl. No.: 13/960,357

(22) Filed: Aug. 6, 2013

(65) Prior Publication Data

US 2014/0165983 A1 Jun. 19, 2014

Related U.S. Application Data

(60) Provisional application No. 61/737,201, filed on Dec. 14, 2012.

(51) Int. Cl.
*F41B 11/642* (2013.01)
*F41B 11/89* (2013.01)

(52) U.S. Cl.
CPC ..... *F41B 11/642* (2013.01); *F41B 11/89* (2013.01); *Y10T 29/49826* (2013.01)

(58) Field of Classification Search
USPC ..... 124/16, 52, 56, 59, 63–67, 73, 76
See application file for complete search history.

(56) References Cited

U.S. PATENT DOCUMENTS 961,511 A 6/1910 Marble
1,374,757 A 4/1921 Napier
1,441,975 A 1/1923 Edelin
2,109,589 A 3/1938 Horwitt et al.
2,375,607 A 5/1945 Wulfert
2,483,752 A 10/1949 Buhl
2,505,428 A * 4/1950 Pope ..... 124/65
2,725,868 A 12/1955 Foster
2,762,356 A 9/1956 Foster
3,262,440 A * 7/1966 Kuhn ..... 124/67
3,765,396 A 10/1973 Kienholz et al.
3,818,887 A 6/1974 Akiyama et al.
3,913,553 A 10/1975 Braughler et al.
3,924,599 A * 12/1975 Hammond ..... 124/67
3,968,783 A 7/1976 Pfotenhauer
4,004,566 A 1/1977 Fischer
4,165,730 A * 8/1979 Jaedicke et al. ..... 124/67
4,170,215 A 10/1979 Kettlestrings
4,248,202 A 2/1981 Jaworski et al.
4,659,320 A 4/1987 Rich et al.
4,843,751 A 7/1989 Ferri
4,850,328 A 7/1989 Sindel
5,113,842 A 5/1992 Moormann
5,150,701 A * 9/1992 Wackrow et al. ..... 124/67
5,186,156 A 2/1993 Clayton
5,267,549 A 12/1993 Webber (Continued)

*Primary Examiner* — Michael David
(74) *Attorney, Agent, or Firm* — Perry Hoffman

(57) ABSTRACT

A toy launch apparatus for discharging soft foam darts, the launch apparatus having a cylinder, a piston, a launch spring and a dart tube. An air chamber with variable volume is formed between the cylinder and the piston and is divided into two or more sections, a first section where there is little or no resistance to relative movement between the cylinder and the piston so that there is a momentum gain, and a second section where there is rapid compression and increasing pressure to cause a loaded dart to be discharged. A third section may be a transition section between the first and second sections.

18 Claims, 13 Drawing Sheets

(56) References Cited

U.S. PATENT DOCUMENTS

| | | | | | |
|---|---|---|---|---|---|
| 5,292,134 | A | | 3/1994 | Schlundt et al. | |
| 5,377,656 | A | | 1/1995 | Lewinski et al. | |
| 5,433,646 | A | | 7/1995 | Tarng | |
| 5,471,967 | A | | 12/1995 | Matsuzaki et al. | |
| 5,517,780 | A | | 5/1996 | Haber et al. | |
| 5,529,050 | A | | 6/1996 | D'Andrade | |
| 5,605,140 | A | | 2/1997 | Griffin | |
| 5,611,322 | A | | 3/1997 | Matsuzaki et al. | |
| 5,711,285 | A | * | 1/1998 | Stewart et al. | 124/67 |
| 5,778,868 | A | | 7/1998 | Shepherd | |
| 5,857,854 | A | * | 1/1999 | Kwalwasser | 434/18 |
| 5,878,734 | A | * | 3/1999 | Johnson et al. | 124/59 |
| 5,996,564 | A | | 12/1999 | Kotowski | |
| 6,224,457 | B1 | | 5/2001 | Wu | |
| 6,598,329 | B1 | | 7/2003 | Alexander | |
| 6,733,356 | B2 | | 5/2004 | Lee | |
| 7,096,618 | B2 | | 8/2006 | McGarry | |
| 7,287,526 | B1 | | 10/2007 | Bligh et al. | |
| 7,360,331 | B2 | | 4/2008 | McGarry | |
| 7,418,797 | B1 | | 9/2008 | Crose | |
| 7,437,847 | B1 | | 10/2008 | Mabry | |
| 7,552,557 | B1 | | 6/2009 | Mabry | |
| 7,673,624 | B2 | | 3/2010 | Rosella, Jr. | |
| 7,686,003 | B2 | | 3/2010 | Witzigreuter et al. | |
| 7,938,110 | B2 | | 5/2011 | Udwin | |
| 8,082,909 | B2 | | 12/2011 | Sopinsky et al. | |
| 8,146,579 | B2 | | 4/2012 | Jablonski et al. | |
| D658,726 | S | | 5/2012 | Greiner | |
| 8,567,378 | B2 | * | 10/2013 | Nugent | 124/59 |
| 8,567,380 | B2 | * | 10/2013 | Nugent | 124/65 |
| 2006/0242880 | A1 | | 11/2006 | Griffin | |
| 2007/0034197 | A1 | | 2/2007 | Tschech | |
| 2007/0261689 | A1 | | 11/2007 | Tai et al. | |
| 2010/0147277 | A1 | | 6/2010 | Zimmerman et al. | |
| 2012/0024278 | A1 | | 2/2012 | Carlson et al. | |
| 2012/0024279 | A1 | | 2/2012 | Carlson et al. | |
| 2012/0125304 | A1 | | 5/2012 | Brooks et al. | |
| 2012/0216786 | A1 | | 8/2012 | Hadley et al. | |

* cited by examiner

TOY LAUNCH APPARATUS WITH MOMENTUM FEATURE

PRIORITY CROSS-REFERENCE TO RELATED APPLICATION

This application is a continuation-in-part and claims priority pursuant to 35 U.S.C. 119(e) from U.S. Provisional Patent Application, No. 61/737,201, filed on Dec. 14, 2012, which Application is expressly incorporated herein by reference.

FIELD OF THE INVENTION

The present invention relates generally to a toy launch apparatus, and, more particularly, to a toy launch apparatus with a momentum feature, in which during an early phase of movement between a cylinder and a piston, air in an air chamber escapes easily so that there is a momentum gain before entry into a later phase where air pressure rapidly increases to enable discharge of a dart.

BACKGROUND OF THE INVENTION

Toys are often designed to have play value by simulating a real object, safely and at a reasonable expense. Toy launch apparatus simulating guns and rifles have been marketed as toys for decades and include such devices as water pistols and rifles, cap guns, BB guns and rifles, dart guns and NERF® brand launchers that discharge a soft foam dart. Most air launchers discharging darts use a launch spring and a piston and cylinder arrangement to generate the energy and direct that energy to cause the dart to discharge. Generally, more energy is developed with a spring having a higher spring rate. However, offsetting more powerful springs is the difficulty in cocking the launcher, especially for young children. Furthermore, from design and function standpoints control of the size and operation of an air chamber in the cylinder is desirable for efficiency and cost considerations.

The inventions discussed in connection with the described embodiments below address these and other deficiencies of the prior art. The features and advantages of the present inventions will be explained in or become apparent from the following summary and description of the preferred embodiments considered together with the accompanying drawings.

SUMMARY OF THE INVENTION

In accordance with the present invention, an advantageous method and apparatus are provided in the form of toy launch apparatus that are designed to discharge soft foam darts. The launchers include a momentum feature that provides several advantages. For example, in some embodiments there are a cylinder, a piston and a dart receiving tube, and the dart receiving tube must be retracted to allow automatic loading of a dart from a magazine. This requires longitudinally directed space in the launchers to do so. The momentum feature allows the use of a less powerful launch spring in such circumstances thereby reducing cocking force required from an operator of the launcher. Another advantage is that there is more control over the volume of air that is being compressed because the length of an air chamber in the cylinder is controlled by the length of the space needed to accommodate a dart from a magazine. The diameter of the piston is controlled by the diameter of the dart receiving tube because the dart receiving tube and an inner tube to which the piston is mounted, slide rearward into the air chamber when the launcher is cocked. Compressing the whole volume of air would be inefficient and difficult. But arranging the piston and the cylinder to allow travel part way along the air chamber at a substantially reduced or no resistance, thereby gaining momentum before air in the chamber begins to compress and raise air pressure, allows for tuning of the compressed air volume and for optimizing launcher performance.

The launch apparatus described below are easily operated, even by young children, and also have the advantages of being simple, easy to operate, fun to use, safe, relatively inexpensive and yet, structurally robust.

Briefly summarized, the invention relates to a toy launch apparatus including a housing, a cylinder mounted to the housing, the cylinder having a first portion and a second portion, a piston mounted in the cylinder to enable relative movement between the cylinder and the piston, a launch spring mounted in the housing for causing the relative movement of the cylinder and the piston, and an air chamber formed in the cylinder by the cylinder and the piston wherein the air in the air chamber moves in a first manner when the piston has relative movement in the first portion of the cylinder and in a second manner when the piston has relative movement in the second portion of the cylinder.

The invention also relates to a method for making a toy launch apparatus, the steps of the method include forming a housing, mounting a cylinder to the housing, the cylinder having a first portion and a second portion, mounting a piston in the cylinder to enable relative movement between the cylinder and the piston, mounting a launch spring connected to the piston and to the cylinder for causing the relative movement of the cylinder and the piston, and forming an air chamber in the cylinder wherein air in the air chamber is enabled to escape easily when there is relative movement between the piston and the cylinder and the piston is in the first portion of the cylinder, and air in the air chamber rapidly increases in pressure when there is relative movement between the piston and the cylinder and the piston is in the second portion of the cylinder.

BRIEF DESCRIPTION OF THE DRAWINGS

For the purpose of facilitating an understanding of the invention, the accompanying drawings and detailed description illustrate preferred embodiments thereof, from which the invention, its structures, its construction and operation, its processes, and many related advantages may be readily understood and appreciated.

DESCRIPTION OF THE PREFERRED EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
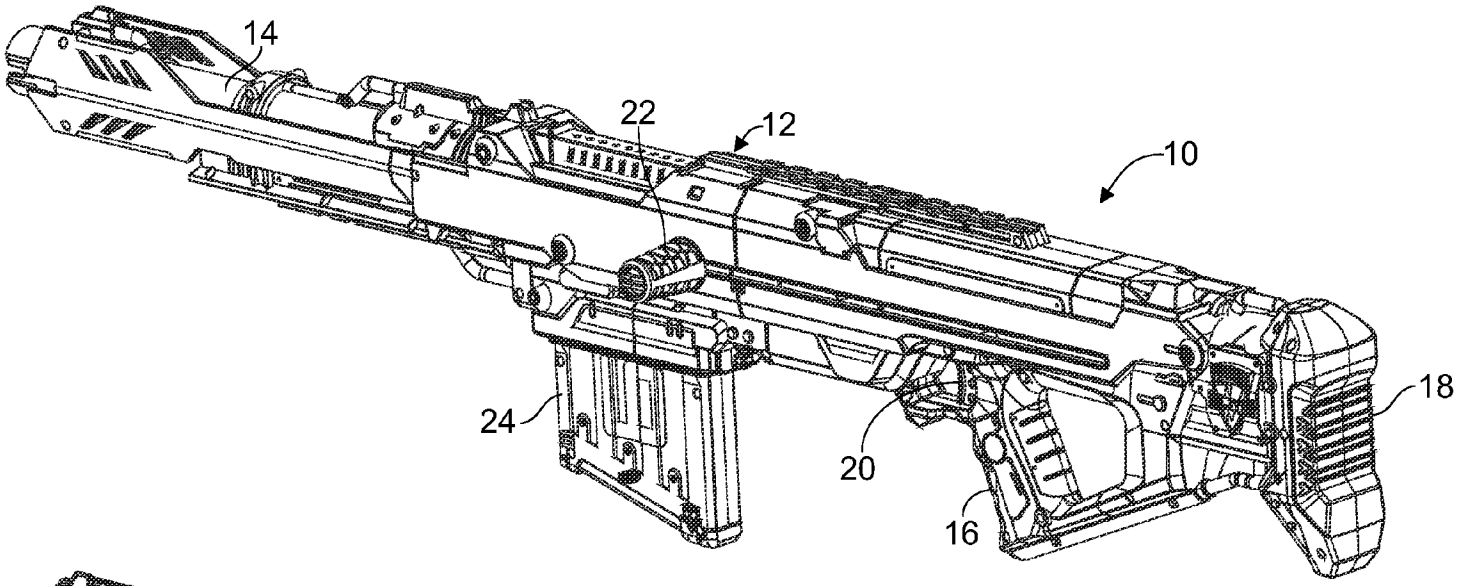
FIG. 1 is an isometric view of a preferred embodiment of the present invention in the form of a toy rifle.
Figure 21:
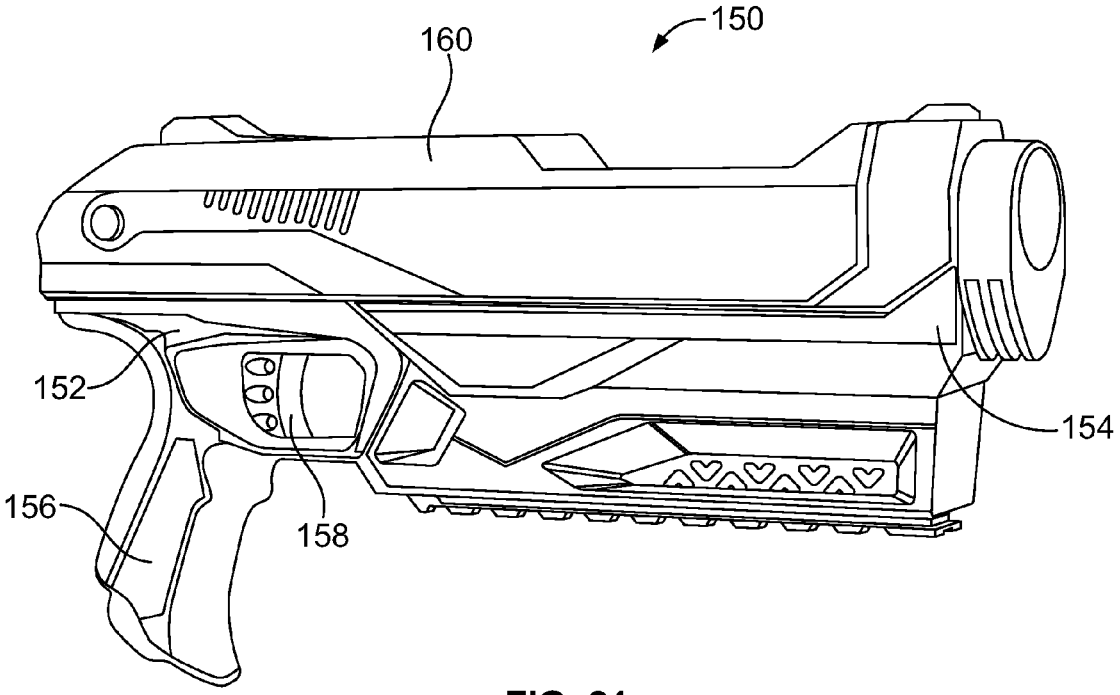
FIG. 21 is an isometric view of another preferred embodiment of the present invention in the form of a toy gun.

Referring to FIG. 1, there is illustrated a toy launch apparatus in the form of a toy dart launching rifle 10 having an outer shell or housing 12, a barrel portion 14 in a forward end portion of the rifle, a grip portion 16, and a shoulder stock portion 18 in a rearward end portion of the rifle. The rifle 10 also includes a trigger 20, a bolt or cocking handle 22 and a mountable magazine 24 filled with darts. The toy launch apparatus may have the appearance of a stylized rifle as shown, of a more realistic rifle, of a gun (as shown in FIG. 21), or of any other fanciful weapon. The darts in the magazine are preferably formed of soft foam such as those marketed under the brand NERF®.

Figure 2:
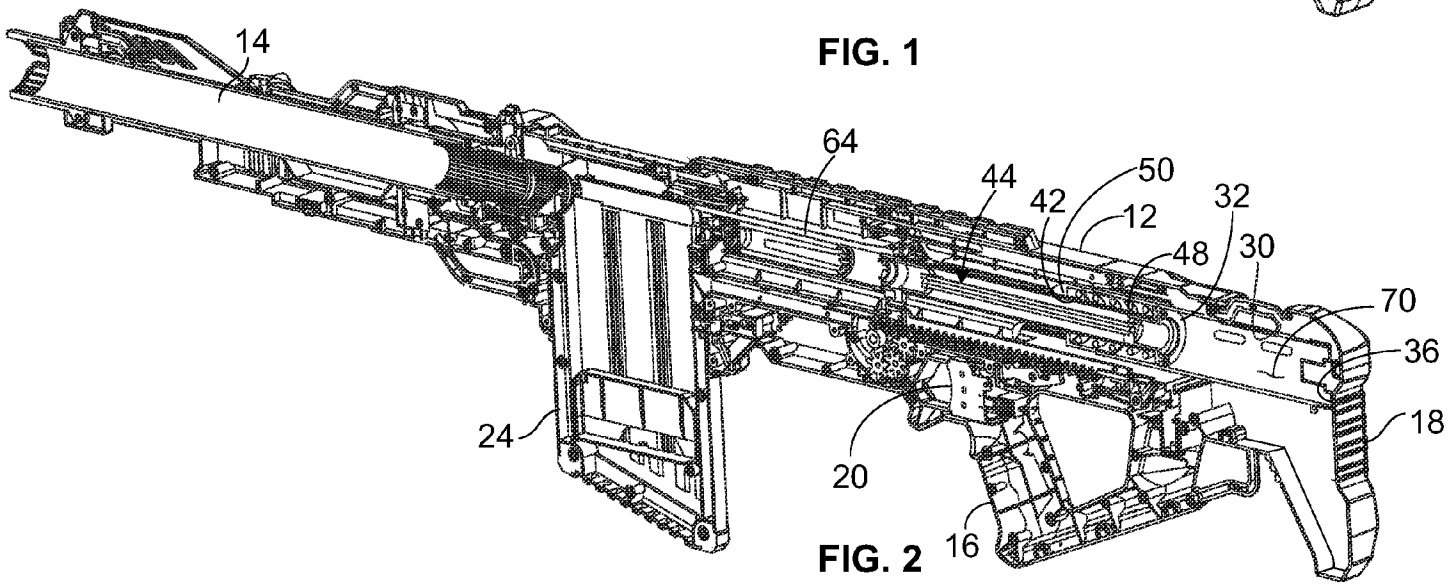
FIG. 2 is an isometric view the toy rifle shown in FIG. 1, with half of the housing removed to reveal internal mechanisms.
Figure 3:
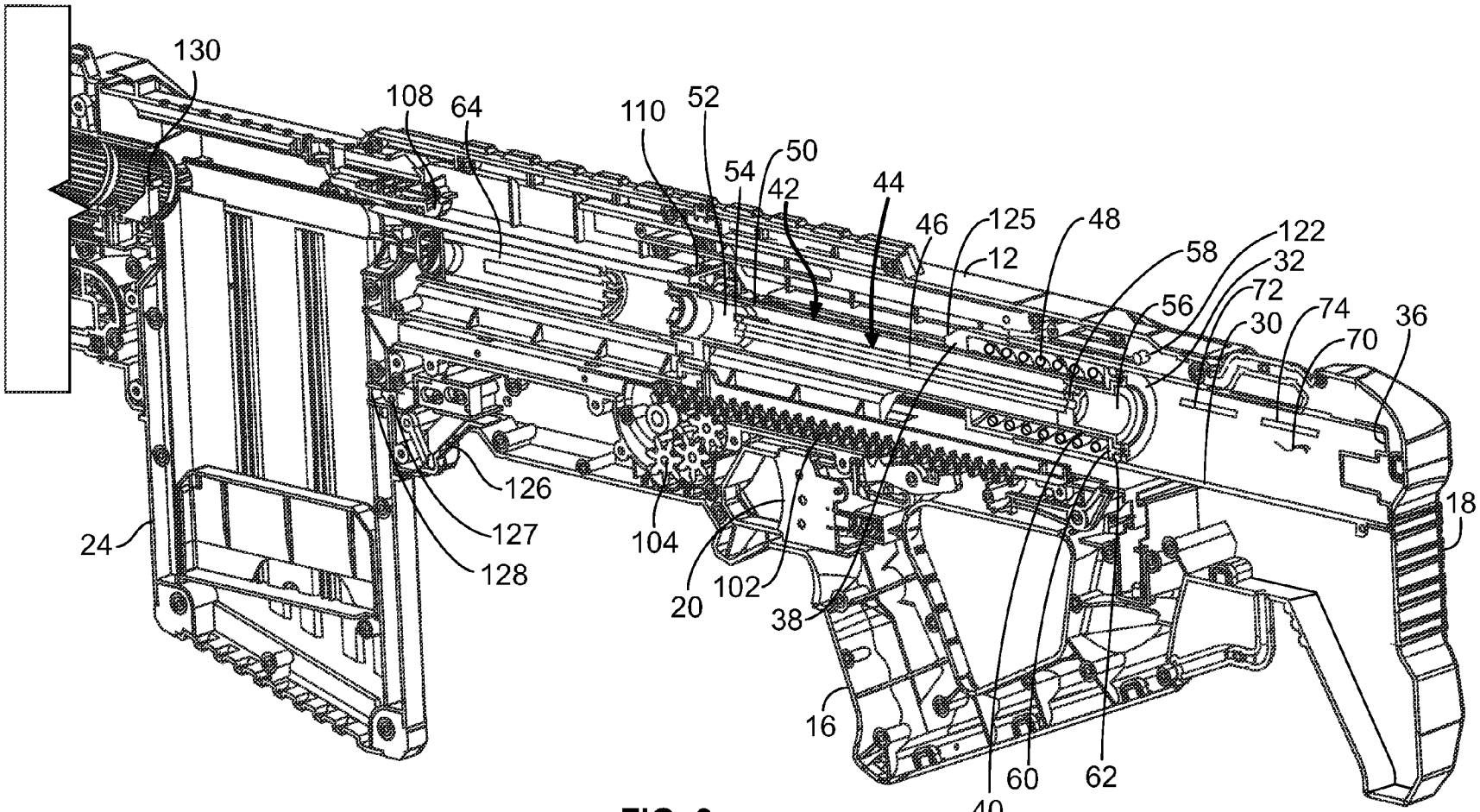
FIG. 3 is an enlarged isometric view of a rearward portion of the toy rifle shown in FIG. 2.

Referring now to FIGS. 2 and 3, there are shown internal mechanisms mounted to the toy rifle 10, including a cylinder 30 and a piston 32. The cylinder 30 has a rear portion 36 and a front portion 38. The piston 32 is at a rear end portion 40 of an inner tube 42 that is mounted in the cylinder and that supports an elongated pipe 44 having an air passageway 46. The air passageway 46 extends from the piston 32 forward to communicate with a loaded dart. A launch spring 48 is mounted between the front portion 38 of the cylinder 30 and the piston 32 for providing energy to launch a dart. The arrangement of the cylinder 30 and the piston 32 allows relative movements between them as will be explain in more detail below. In the embodiment shown in FIGS. 1-3, both the cylinder and the piston are movable but air is compressed when the cylinder moves toward the piston when the piston is stationary.

The inner tube 42 includes a front-end portion 50. The inner tube front-end portion 50 supports a front bushing 52 for mounting and supporting a front-end portion 54 of the elongated pipe 44. The rear end portion 40 of the inner tube 42 supports a rear bushing 56. The rear bushing 56 mounts and supporting a rear end portion 58 of the elongated pipe 44. Also, mounted to the rear bushing 56 is the piston 32 having an O-ring mounting 60 and an O-ring seal 62. A dart surround structure in the form of a dart receiving tube 64 is mounted to the front bushing 52. The dart tube replaces a bolt of a real rifle using metal-jacketed ammunition and solves the problem of soft dart jamming.

Figure 9:
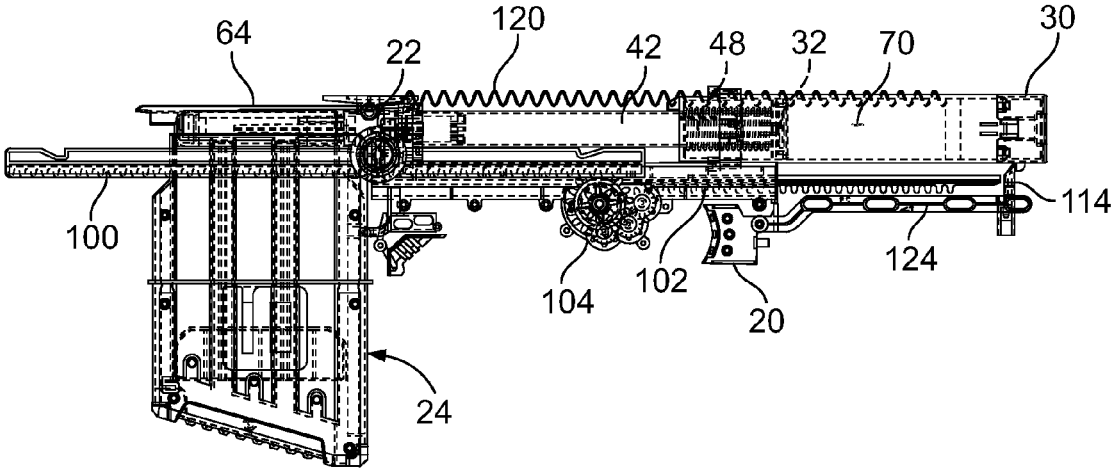
FIG. 9 is a diagrammatic side elevation view like those shown in FIGS. 5-8, but with the cocking handle returned forward after the toy rifle is fully cocked.
Figure 11:
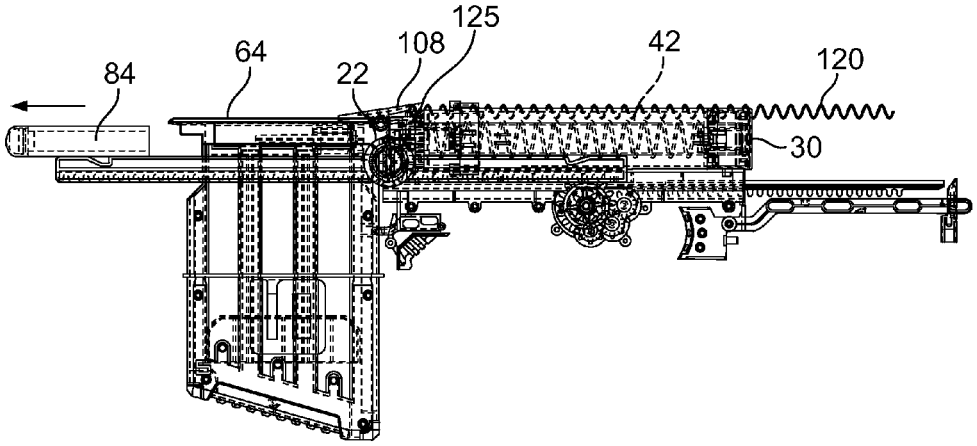
FIG. 11 is a diagrammatic side elevation view like those shown in FIGS. 5-10, and where the launch spring is relaxed and the air chamber is fully contracted, but the return spring remains fully extended.

The rear portion 36 of the cylinder 30 forms with the piston 32 an air chamber 70 between them, and air in the air chamber 70 is able to communicate with the dart tube 64 through the piston 32, the rear bushing 56, the air passageway 46 in the pipe 44, and the front bushing 52. The cylinder 30 is slideable relative to the piston 32 between an extended position when the launch spring 48 is compressed or cocked, as shown in FIG. 9, and a retracted position when the launch spring is relaxed, as shown in FIG. 11, such that the volume of the air chamber 70 is variable as a function of the position of the cylinder 30 relative to the piston 32.

Figure 14:
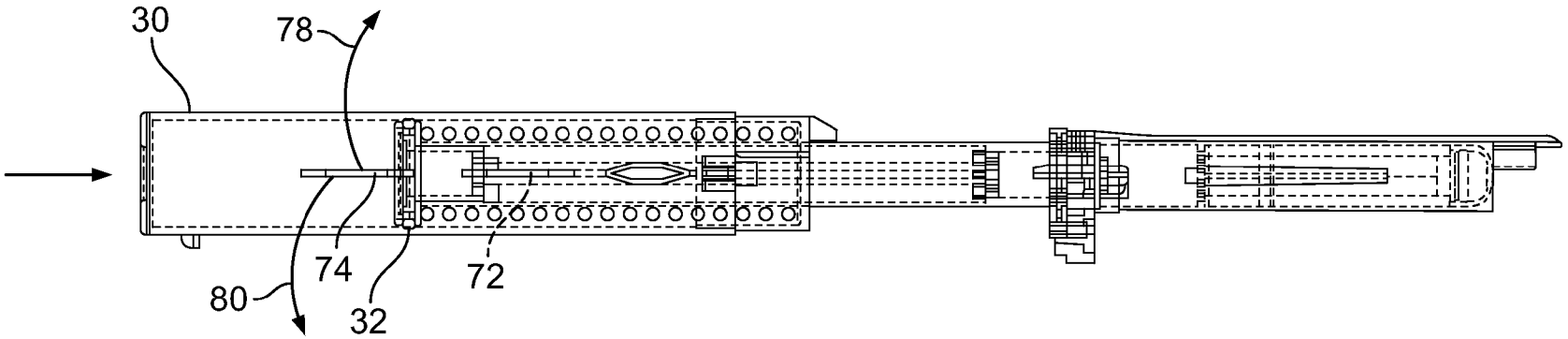
FIG. 14 is a diagrammatic side elevation view like that shown in FIG. 13, and illustrating relative motion between the cylinder and the piston with the piston in a first portion of the cylinder where air from the air chamber escapes easily.
Figure 15:
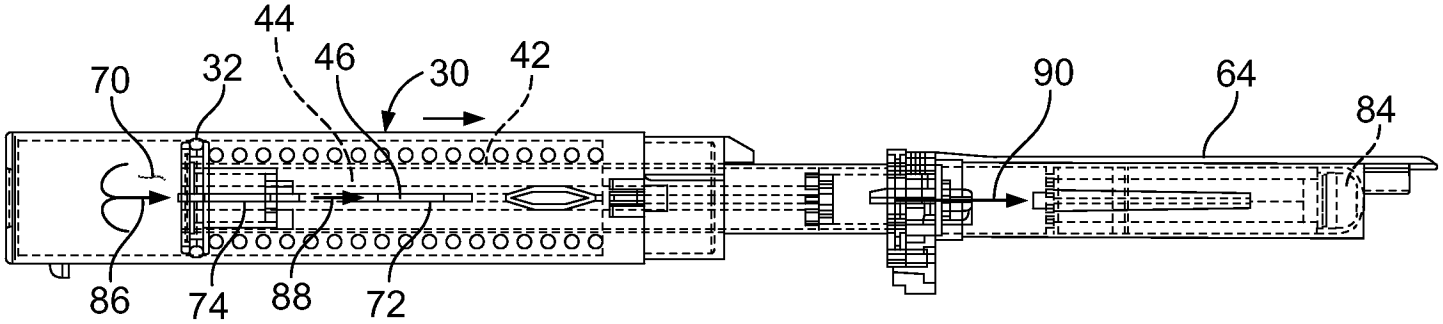
FIG. 15 is a diagrammatic side elevation view like those shown in FIGS. 13 and 14, and illustrating the piston in a second portion of the cylinder where pressure of the air in the air chamber increases rapidly and the pressure is directed to the dart.

The cylinder 30 also includes longitudinally extending slot-shaped air ports, such as the ports 72, 74, FIG. 3, to allow air from the air chamber 70 to easily escape as the air chamber contracts during relative movement of the cylinder and the piston, thereby allowing the moving element, the cylinder in the embodiment shown in FIGS. 1-3, to gather momentum after the trigger 20 is pulled. This momentum feature will also be explained in more detail below in relation to FIGS. 13-16. With brief reference to FIG. 13, a first section or portion 76 of the cylinder 30 to the left of the piston 32, and including both of the ports 72, 74, allows momentum of the relatively moving cylinder/piston to be gained because air in the air chamber 70 moves in a first manner. The first manner of air movement allows easy escape through the ports 72, 74 as symbolized by arrows 78, 80, FIG. 14. A second section or portion 82, FIG. 13, of cylinder 30 to the left of a left end of the port 74 (as viewed in FIG. 13) shows air movement in a second manner because the air can no longer pass through the ports 72, 74, but instead air flow is restricted through the piston 32 and the air passageway 46 to the dart tube 64 to cause discharge of a dart 84. Three arrows 86, 88, 90 as shown in FIG. 15, symbolize this second manner of air movement.

Figure 4:
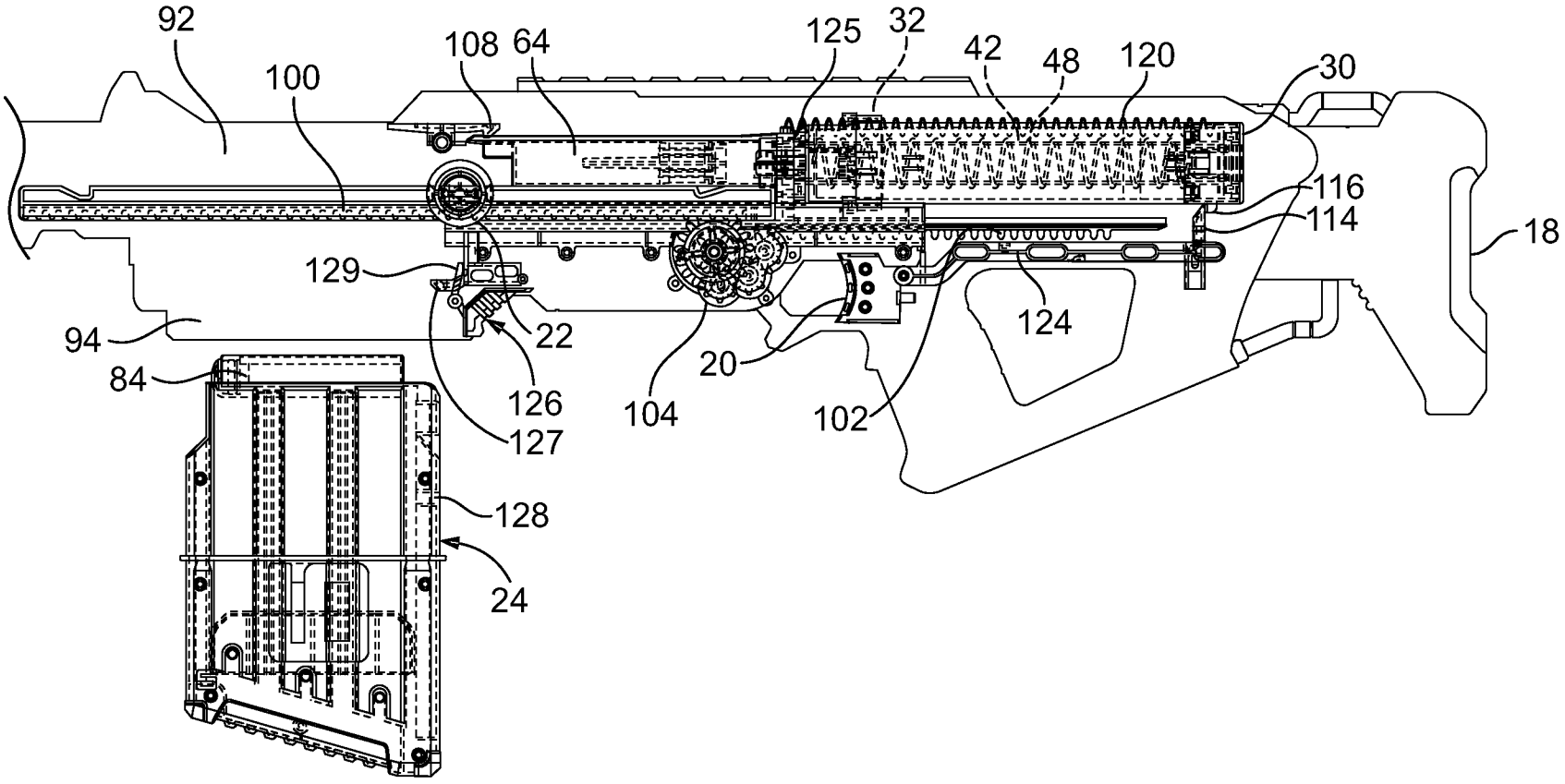
FIG. 4 is a diagrammatic side elevation view of the portion of the toy rifle shown in FIG. 3, highlighting certain internal mechanisms and a disengaged dart magazine.

Referring now to FIG. 4, the rifle 10 is shown in diagrammatic form stripped of some elements for clarity, and with the magazine 24 detached from the rifle. When the magazine is inserted into a rifle magazine well 94, a dart, such as the top dart 84, is located in a launch chamber 92 aligned with the dart tube 64, as well as the cylinder 30 and the inner tube 42. Before cocking, the dart tube 64, the inner tube 42 with the piston 32, and the cylinder 30 are in rearward positions as shown. To cock the rifle, additional elements to those already mentioned are present, including a linkage in the form of a first rack 100, a second rack 102 and a gear train 104. The cocking handle 22 is connected to the first rack 100 and when an operator moves the handle rearward, the first rack 100 also moves rearward. The rearward motion of the first rack 100 is converted by the gear train 104 to forward motion for the second rack 102, and when the handle 22 is returned forward to complete the cocking of the rifle, the first rack 100 returns forward and because of the gear train 104 the second rack 102 is returned rearward. When the second rack moves forward, the launch spring 48 is compressed as the piston 32 and the dart tube 64 move forward, but the cylinder 30 stays stationary. A first fastener including a pivot bar 108 mounted to the housing for engagement with a cross bar 110, FIG. 3, mounted on the dart tube 64, restrains the dart tube 64 and the piston 32 in forward positions. In the meantime a second fastener including a sear 114, FIG. 4, mounted to the housing and a tab 116 mounted to the cylinder 30 restrains the cylinder 30 in a rearward position.

A return spring 120, FIG. 4, is connected at one end to the housing 12 at a post 122, FIG. 3, and at an opposite end to the cross bar 110. When the dart tube 64 moves to its forward position the return spring 120 is extended to create a biasing force to return the dart tube to its rearward position automatically, without any further input from an operator. It is noted that this differs from the launch spring 48, which creates a biasing force by being compressed. The trigger 20 is connected to a link 124, FIG. 4, which is connected to the sear 114. When the operator pulls the trigger, the link 124 retracts the sear 114 away from the tab 116 and the cylinder 30 snaps forward as the launch spring 48 extends. When the cylinder reaches its forward position, an abutment structure in the form of a nose ramp 125, FIG. 3, mounted to the cylinder 30 engages and lifts the pivot bar 108 to allow the return spring 120 to bias the dart tube 64, the inner tube 42 with the piston 32, as well as the cylinder 30 to their rearward positions. After the return spring pulls the elements rearward a dart is able to move upward driven by a spring in the magazine 24. This automatic retraction is an important feature of the product.

A magazine latch and release mechanism 126 is mounted to the housing 12 and functions to latch the magazine 24 with a spring biased pin 127 that engages structure around an opening 128 in the magazine. A lever actuator 129 is mounted to the housing to retract the pin 127 when the actuator is pressed so that the magazine 24 is released or disengaged from the rifle. A small barrier panel 130, FIG. 3, is positioned just forward of the launch chamber 92 to prevent forward movement of a dart. When the dart tube 64 is moved fully forward during the process of cocking rifle, the barrier panel 130 pivots to a lowered position to allow dart discharge.

Figure 5:
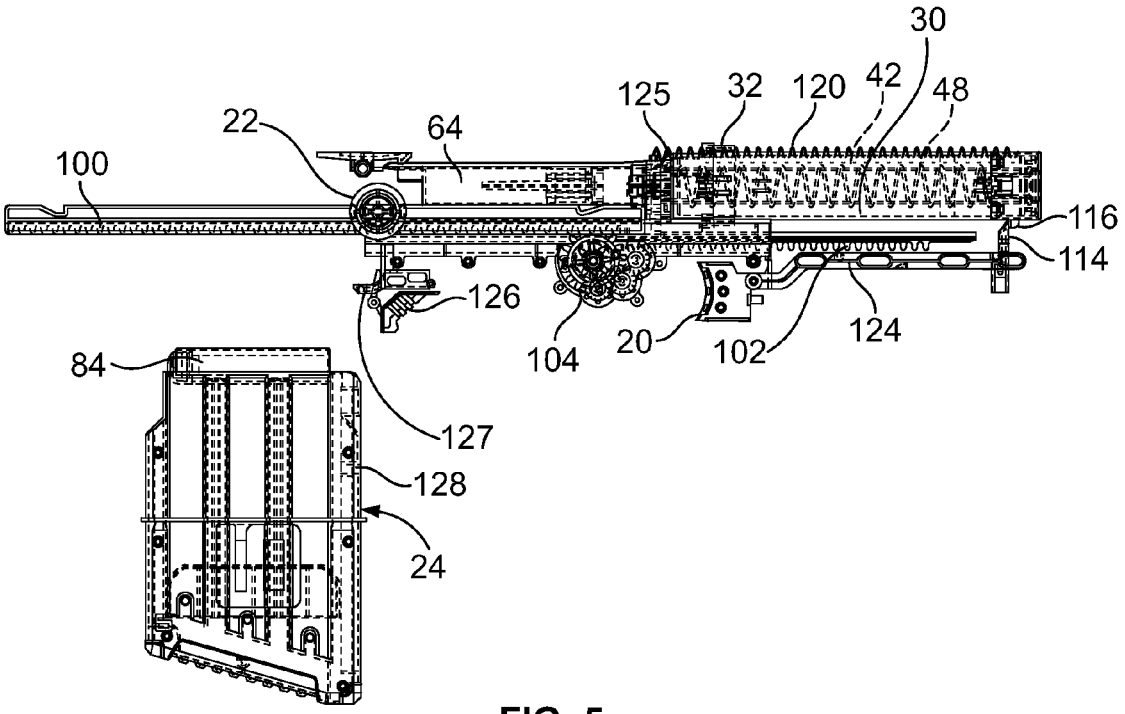
FIG. 5 is a diagrammatic side elevation view of the internal mechanisms shown in FIG. 4, including a cylinder and a piston, and the disengaged dart magazine, but without an outline of a rifle housing.
Figure 6:
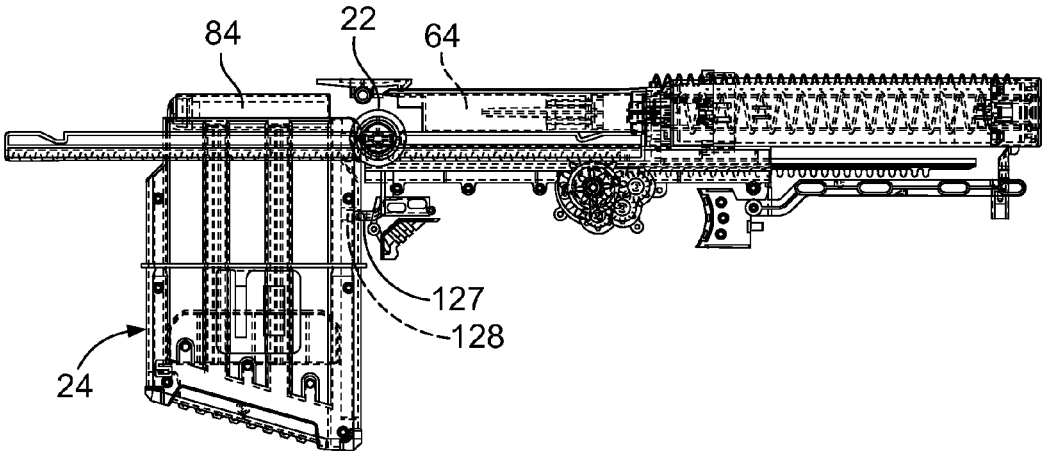
FIG. 6 is a diagrammatic side elevation view like that shown in FIG. 5, but with the dart magazine connected to the rifle, a launch spring in a relaxed configuration, and a dart in the magazine aligned with a dart tube in the rifle.
Figure 7:
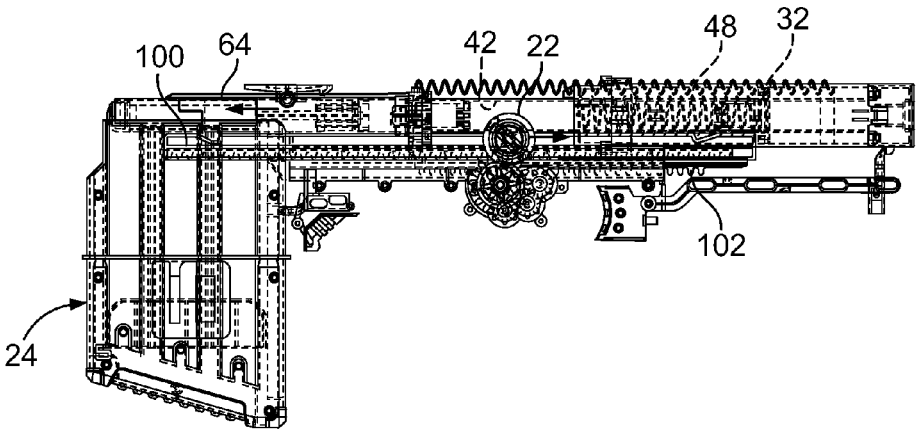
FIG. 7 is a diagrammatic side elevation view like those shown in FIGS. 5 and 6, but with a cocking handle drawn partially rearward, the launch spring partially compressed, a return spring partially extended, an air chamber partially formed in the cylinder and the dart tube partially positioned around the dart.

The general operation of the rifle is explained in more detail with reference to FIGS. 5-12. The illustration shown in FIG. 5 is the same as the illustration shown in FIG. 4, except that the portion of the housing outline shown in FIG. 4 has been eliminated for clarity. In FIG. 5, the dart tube 64, the inner tube 42 and the cylinder 30 are in their rearward positions, and the cylinder is restrained by the engagement of the sear and tab fastener 114, 116. The cocking handle 22 is in a forward position and the launch spring 48 is in a relaxed extended configuration. When the magazine is engaged with the rifle by being inserted into the magazine well 94, FIG. 4, the uppermost dart 84 becomes aligned with the dart tube 64 as shown in FIG. 6, and the pin 127 mounted to the housing is received by the opening 128 in the magazine. Referring now to FIG. 7, the cocking handle 22 is shown drawn part way rearward causing the first rack 100 to move rearward, and the second rack 102, the dart tube 64 and the inner tube 42 with the piston 32 to move forward while the cylinder 30 remains stationary, resulting in the launch spring 48 being partially compressed between the piston 32 and the forward portion 38 of the cylinder 30.

Figure 8:
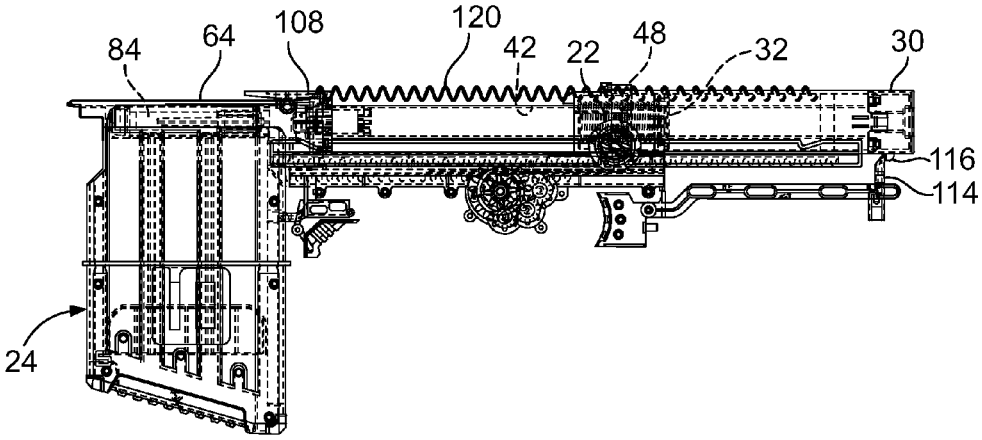
FIG. 8 is a diagrammatic side elevation view like those shown in FIGS. 5-7, but with the cocking handle drawn fully rearward, the launch spring fully compressed, the return spring fully extended, the air chamber fully formed and the dart fully received by the dart tube.

When the cocking handle 22 is drawn fully rearward, as shown in FIG. 8, the dart tube 64 and the inner tube 42 with the piston 32 have moved fully forward with the dart tube 64 enclosing the dart 84 and blocking another dart from the magazine being loaded. The launch spring 48 is fully compressed, in a cocked configuration, to provide the biasing force for discharging the dart. The return spring 120 is fully extended to bias the dart tube rearward when released. The cylinder 30 remains restrained by the sear and tab fastener 114, 116, and the pivot bar and cross bar fastener 108, 110 becomes engaged so that the dart tube 64 and the inner tube 42 are restrained forward while the cylinder 30 is restrained rearward. If the rifle 10 is configured with a safety valve, that valve will be opened.

Referring now to FIG. 9, the cocking handle 22 has been returned forward by the operator to complete a full cocking cycle of the rifle. When the cocking handle 22 is returned to the forward position, the first rack 100 and the second rack 102 are returned to their original positions by operation of the handle 22 and the gear train 104. The dart tube 64 and the inner tube 42 with the piston 32 remain restrained fully forward, the launch spring 48 remains fully compressed, the return spring 120 remains fully extended and the cylinder 30 remains restrained rearward.

Figure 10:
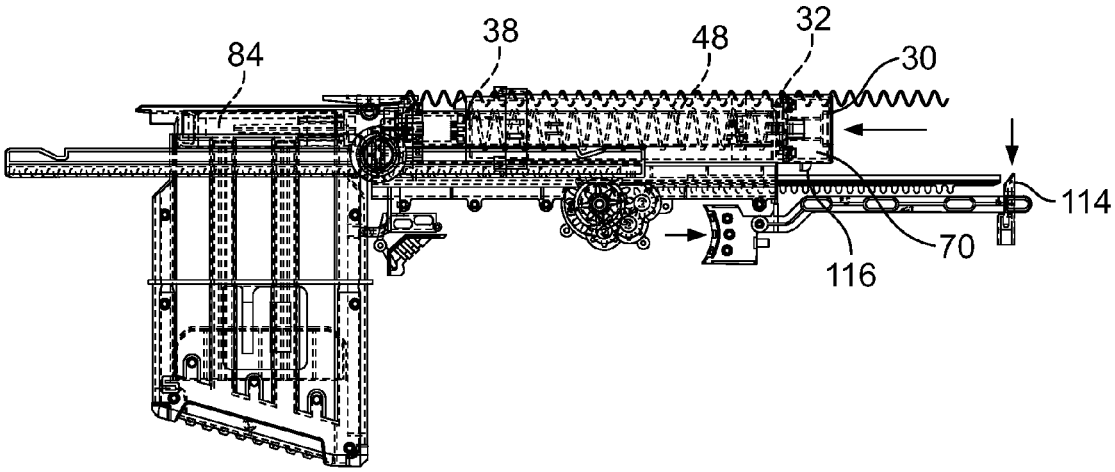
FIG. 10 is a diagrammatic side elevation view like those shown in FIGS. 5-9, and after a trigger is pulled, such that the launch spring is partially extended and the air chamber is partly contracted, but the return spring is still fully extended.

When the operator pulls the trigger 20, the link 124 retracts the sear 114, FIG. 10. The sear 114 slides away from the tab 116, and the cylinder 30 is release to snap forward. The launch spring 48 pushes on the front portion 38 of the cylinder 30 causing the cylinder to move forward quickly while the piston remains stationary. The movement of the cylinder is allowed to proceed initially without much resistance so as to gain momentum, an important feature of the invention. The movement of the cylinder 30 relative to the piston 32 causes the air chamber 70 to contract quickly through the cylinder first portion 76, FIG. 13, resulting in momentum gain of the cylinder, but when the piston 32 enters the cylinder second portion 82, the ports 72, 74 are closed (because the ports are to the right of the piston's position) and pressure in the chamber increases quickly. The high pressure is communicated through the air passageway 46 to the dart 84. As the cylinder reaches its forward position shown in FIG. 11, the nose ramp 125, FIGS. 3 and 11, strikes and lifts the pivot bar 108 from the cross bar 110. The small barrier panel 130 in front of the dart 84 will be in its downward position to clear the way for the dart 84 to be launched as shown.

Figure 12:
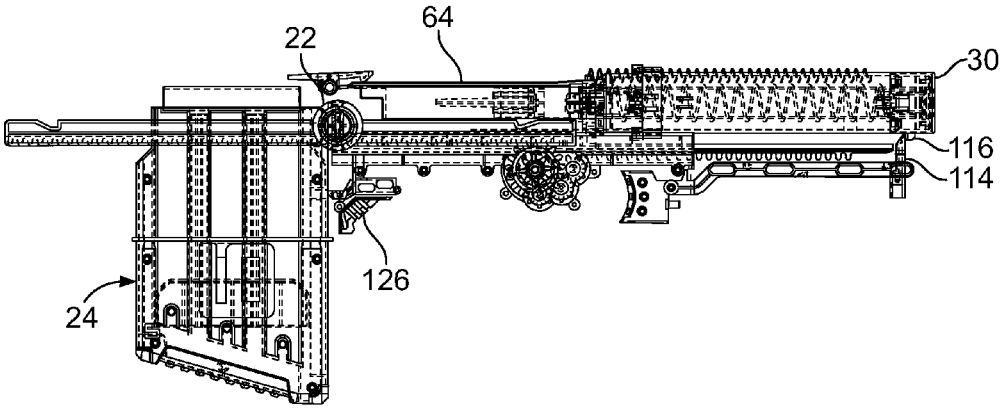
FIG. 12 is a diagrammatic side elevation view like those shown in FIGS. 5-11, and where the return spring is relaxed after pulling the dart tube and the cylinder rearward to the positions shown in FIG. 6.

Meanwhile, the return spring 120 starts to move the dart tube 64, the inner tube 42 and the cylinder 30 to their rearward positions. Thereafter, as shown in FIG. 12, the sear 114 reengages the tab 116 of the cylinder 30. With the dart tube 64 removed from the launch chamber 92, the magazine 24 may spring load another dart into the launch chamber, or if the magazine is empty or nearly so, the magazine 24 may be separated or disengaged from the rifle by pressing the magazine release actuator 132 and a fresh magazine may be engaged without the operator first having to move a bolt or handle or take any action at all (other then handling the magazines), a major advantage that allows quick reloading during play.

It is noted that throughout this description, words such as "forward," "rearward," "front" and "rear," as well as similar positional terms, refer to portions or elements of the launch apparatus as they are viewed in the drawings relative to other portions, or in relationship to the positions of the apparatus as it will typically be held and moved during play by a user, or to movements of elements based on the configurations illustrated.

Referring now to FIGS. 13-17, the detailed operation of the momentum feature of the present invention is explained. It is noted that in FIGS. 13-16, the cylinder 30 and piston 32 are illustrated 180° away from the illustrations of the cylinder and piston shown in FIGS. 4-12. Beginning with the cylinder 30, FIG. 13, and the piston 32 in a cocked position like that shown in FIG. 9, the inner tube 42 with the piston 32 and the dart tube 64 are secured in their forward positions, and the cylinder is restrained in its rearward position by the first and second fasteners respectively. The dart tube 64 is already loaded with the dart 84 and the launch spring 48 is already fully compressed. The air chamber 70 in the cylinder 30 is clearly divided into the first portion 76 where because of the air escape ports 72, 74, the moving cylinder 30 meets little or no resistance because air in the air chamber 70 is easily expelled through the air ports 72, 74 as symbolized by the arrows 78, 80, FIG. 14. Hence, once the trigger is pulled, the cylinder moves freely (to the right in FIGS. 13-17) and gains momentum when the piston 32 is located in the first portion 76 of the cylinder.

Figure 16:
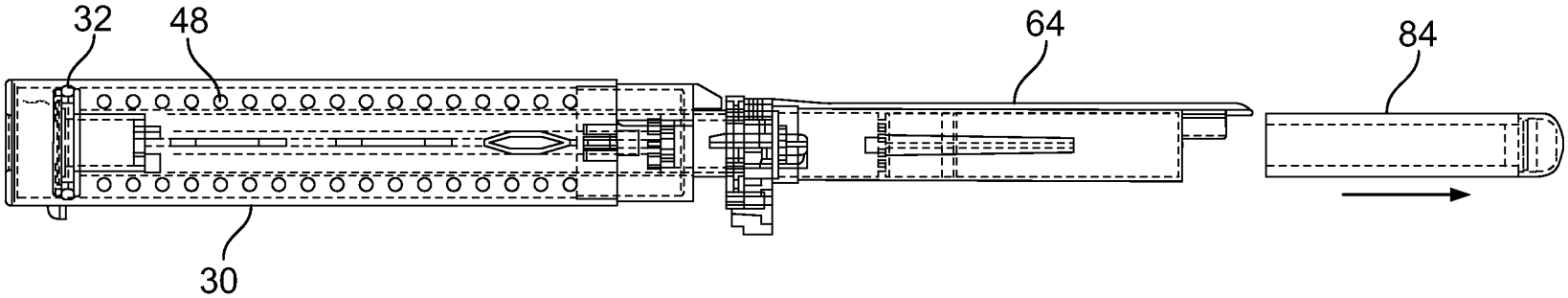
FIG. 16 is a diagrammatic side elevation view like that shown in FIGS. 13-15, illustrating discharge of the dart.
Figure 17:
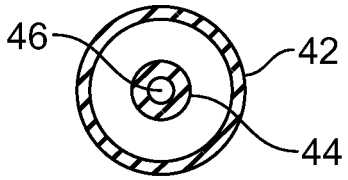
FIG. 17 is an enlarged sectional view taken along line 17-17 of FIG. 13.

Once the piston 32 passes the air escape port 74, as shown in FIG. 15, the only escape path for the air in the now smaller air chamber is through the piston 32, and the air passageway 46, FIGS. 15 and 17, in the inner tube 44, a much more restricted path than through the ports 72, 74. The momentum of the rapidly moving cylinder 30, in addition to the force from the launch spring 48, causes the remaining air in the chamber 70 to quickly compress with a concurrent rapid increase in pressure. The high-pressure air communicates with the dart 84, as symbolized by the arrows 86, 88, 90, FIG. 15, to cause discharge of the dart as shown in FIG. 16.

An alternate way of considering the air chamber 70 is that the chamber has a variable volume, but the variable volume is due solely to a varying length since the chamber and piston have constant diameters. The air chamber 70 illustrated in FIG. 13, has a first or long length equal to the combined lengths of both the first and second portions 76, 82 when the piston is in its forward position and the launch spring 48 is fully compressed. As illustrated in FIG. 16, the air chamber has a second or short length when the piston reaches its rearward position and the launch spring 48 is relaxed. A third, middle length is illustrated in FIG. 15, and is equal to the length of the cylinder second portion 82 and is the length of the air chamber where the air changes the manner of flow from that shown in FIG. 14, to that shown in FIG. 15. Hence, between the air chamber's first and third lengths the air flows out easily with little or no increase in pressure. But when the air chamber is between the second and third lengths, the air is compressed and the resulting high pressure is communicated to the dart causing its discharge.

To achieve the advantage of using the dart tube 64 and the return spring 120 as explained above, the dart tube must be retracted to allow either automatic loading of a dart from the magazine and/or easy replacement of the magazine. Allowing the dart tube to retract out of the way of the darts in the magazine will usually require a relatively long air chamber and a strong launch spring. The long air chamber and a strong launch spring will in turn require considerable force to cock the launcher. The advantages of the momentum feature is that a less powerful launch spring may be used, thereby reducing the cocking force required, an important consideration for a toy for children. Another advantage is that there is more control over the volume of air that is being compressed because the length of the air chamber in the cylinder is initially controlled by the open space needed to load a dart from the magazine. In addition, the diameter of the piston is controlled by the diameter of the dart tube because the piston/inner tube slides in the air chamber/cylinder. The diameter is a fixed variable. Compressing the whole volume of air is inefficient, difficult and unnecessary. However, arranging the piston to travel part way along the air chamber at a substantially reduced or no resistance allows momentum gain before the piston starts compressing air in the chamber. This allows the compressed air volume to be tuned to achieve a desired result and launcher performance is optimized.

Figure 13:
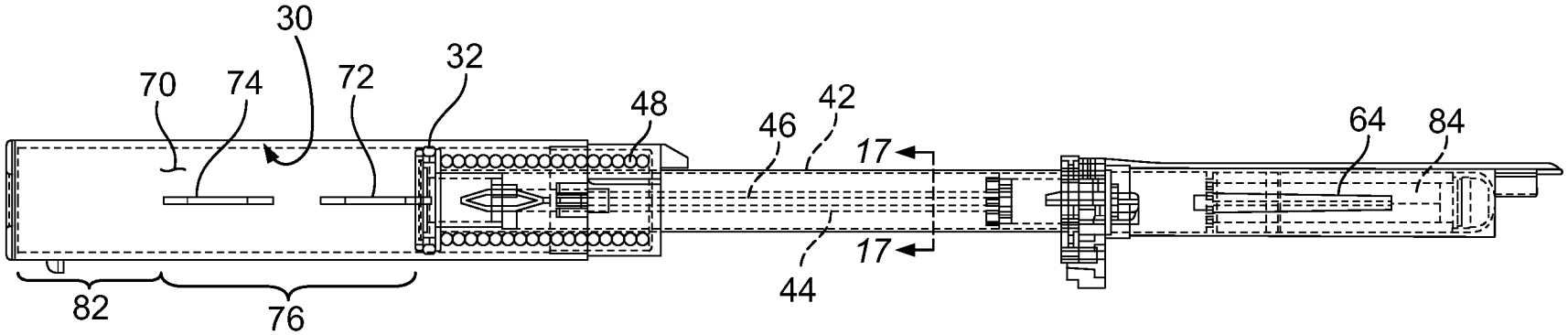
FIG. 13 is a diagrammatic side elevation view of the cylinder, where the piston, the dart tube, and the launch spring are orientated 180° from the views shown in FIGS. 5-12, and where the launch spring is fully compressed and the dart tube has received a dart.
Figure 18:
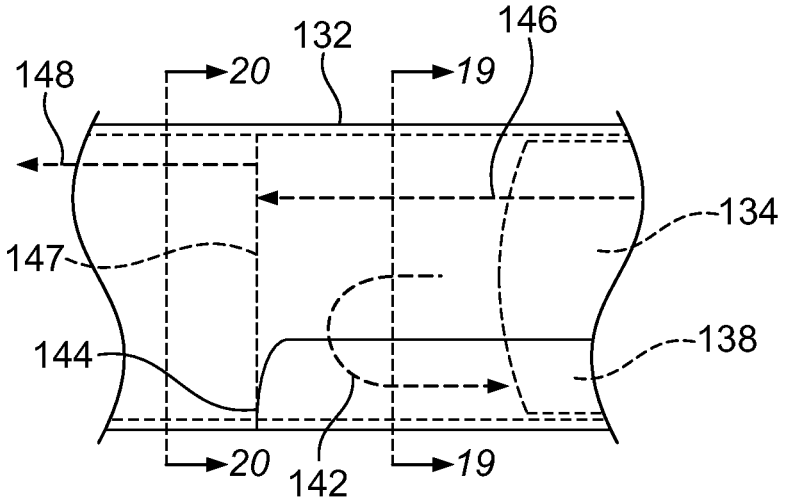
FIG. 18 is a longitudinal section view of a portion of a cylinder and piston and illustrating a side channel for exhausting air from the cylinder.
Figure 19:
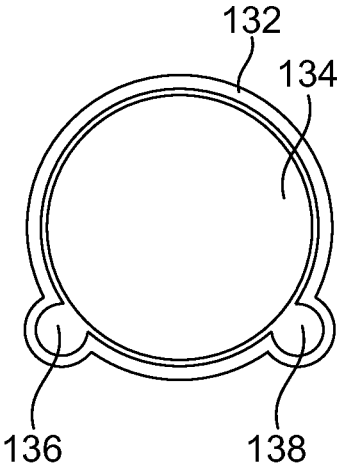
FIG. 19 is a section view taken along line 19-19 of FIG. 18.
Figure 20:
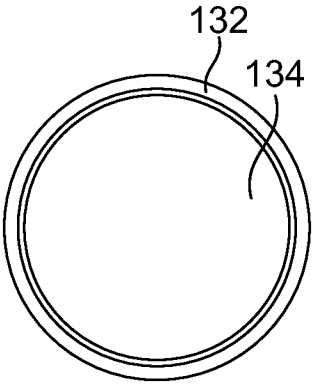
FIG. 20 is a section view taken along line 20-20 of FIG. 18.

An alternative structure for achieving what is termed here, the momentum feature, is illustrated in FIGS. 18-20. There is shown a portion of a cylinder 132, FIG. 18, and a piston 134 moving right to left. The cylinder includes two air channels 136, 138, FIG. 19, so that air in a chamber in front of the moving piston may escape easily as symbolized by the arrow 142. The channels, however, end at a wall 144 so that channels are absent from a downstream cross section, as seen in FIG. 20, and air in the chamber beyond the ends of the channels wall is compressed. The cylinder may be considered to have a first section 146 to the right of an imaginary line 147 located at the wall 144 where the channels 136, 138 end, and a second section 148 to the left of the line 147, just as the cylinder 30, FIG. 13 is divided into two portions 76, 82. Because of the open channels 136, 138, the moving piston 134 meets little or no resistance since air in the air chamber is easily expelled through the channels. Therefore, the piston moves freely and gains momentum. When the piston passes the line 147, however, the piston closes off the channels and air in the air chamber is compressed and pressurized. The length of the channels may be considered as the excess length of the air chamber beyond that needed to launch a dart. Use of a two section cylinder separates the space needed to accommodate a dart and the length of a desired air chamber. Therefore, it is important to note that the length of the air chamber required for suitable discharge of a dart need not be congruent with the length of the cylinder.

An alternative embodiment of a launch apparatus is illustrated in FIG. 21. Instead of the rifle 10, the toy launch apparatus takes the form of a somewhat stylized gun 150 having a housing or shell 152 with a barrel portion 154 and a grip portion 156. The gun 150 includes a trigger 158, a cocking handle 160 and an interior magazine (not shown), which loads from the top of the gun.

Figure 22:
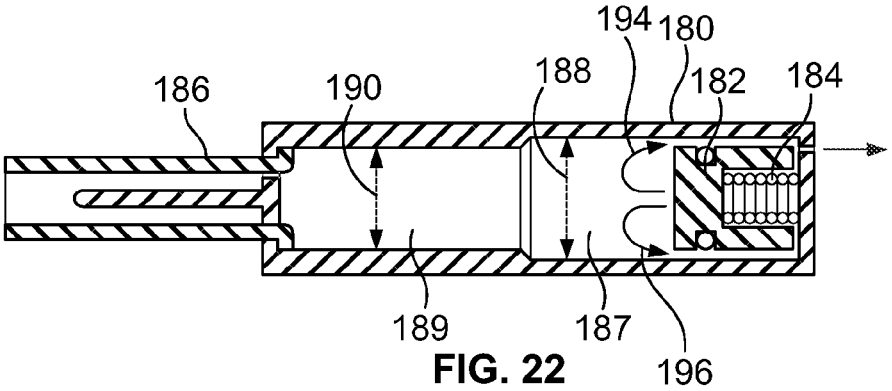
FIG. 22 is a diagrammatic side elevation view illustrating an embodiment of a cylinder having a first portion of larger diameter, a second portion of smaller diameter and a third portion as transition.
Figure 23:
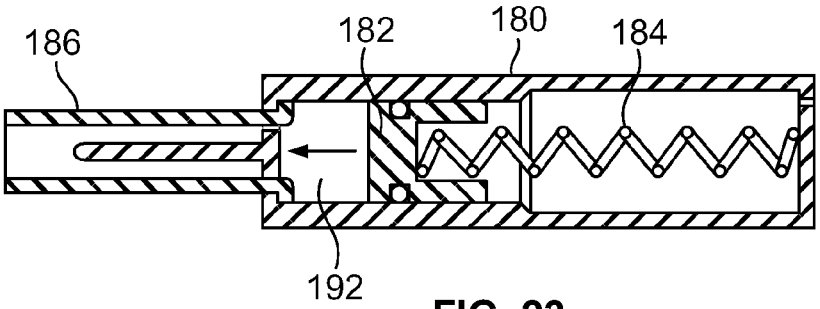
FIG. 23 is a diagrammatic side elevation view of the cylinder shown in FIG. 22, with the piston moving forward in the second portion of the cylinder.
Figure 24:
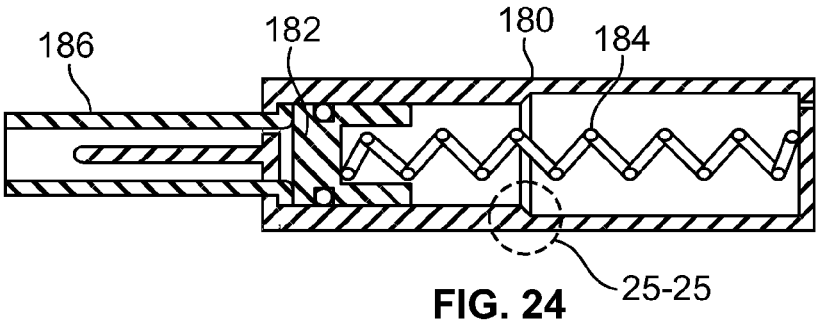
FIG. 24 is a diagrammatic side elevation view of the cylinder shown in FIGS. 22 and 23, but with the piston positioned at the end of forward movement.
Figure 25:
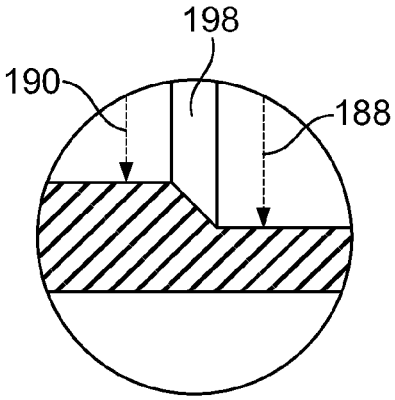
FIG. 25 is an enlarged sectional view taken within circle 25-25 of FIG. 24.

Another embodiment of the momentum feature is shown in exaggerated, diagrammatic form in FIGS. 22-25. First, it is noted that the views of FIGS. 22-24 are rotated 180° from those shown in FIGS. 13-16. The new embodiment includes a cylinder 180, a piston 182, a launch spring 184 and a dart tube 186. Second, the new embodiment is different in that instead of the air ports 72, 74, the cylinder 180 includes a first portion or section 187 having a larger inner diameter symbolized by a double headed arrow 188, a second portion or section 189 having a smaller inner diameter symbolized by a double headed arrow 190 and a third, tapered or transition portion or section 198, FIG. 25. The piston 182 is sized to fit snugly in the smaller inner diameter portion 189 of the cylinder 180 and loosely when in the cylinder portion 187 with the larger inner diameter 188. While the views shown are exaggerated, when the piston begins its travel from right to left, as viewed in FIGS. 22-24, air in an air chamber to the left of the piston 182 will easily flow rearward around the piston as symbolized by two arrows 194, 196 so that there is little or no resistances to the moving piston. This allows the piston to build momentum because the piston movement does not operate in typical fashion because little or no pressure is created. There is no or little effect on the air in the chamber. However, once the piston passes the transition portion 198 between the larger and smaller inner diameter portions 187, 189, air in the now shrinking air chamber is forced to be expelled forward through restricted openings to the dart tube 186 such that there is a rapid pressure increase used to discharge the dart that would be loaded in the dart tube 186.

The ratios of the first portion to the second portion and the ratios of the first and second portions to the third portion may vary according to the designs and specifications of toy rifles and guns. For example, the longer the rifle and its darts, the longer may be the first portion having the larger inner diameter. The need for more force to expel a dart, the longer will be the second portion having the smaller inner diameter and/or the longer the first portion to allow greater momentum gain. For another example, the second portion having the smaller inner diameter may be constant among a number of different shaped toys so that the energy to be transferred to cause discharge of a dart is generally constant among them even though the first portion may vary widely. In the present described embodiment the relative cylinder length of 100% is divided approximately as 40% to the first portion, approximately 40% to the second portion and approximately 20% to the third portion. In other words, the first and second portions are about twice the length of the third or transition portion, which, of course, is visually different from that shown in the illustrations of FIGS. 22-24.

Whether the piston 182 is in the larger diameter portion 187 of the cylinder in the embodiment shown in FIGS. 22-25, or in the first portion 76 as in the embodiment shown in FIGS. 13-16, the momentum gain occurs because of air escape structures, namely, the air ports 72, 74, or from the enlarged cylinder diameter 188, or through the channels 136, 138, FIGS. 18 and 19. Of course, other arrangements may be devised where during an early movement between a piston and a cylinder, air is easily expelled so that the momentum advantage is achieved. One such alternative is a cylinder with a stepped inner diameter.

Using the three-sectioned cylinder, having a larger diameter rearward, a smaller diameter forward and a middle transition portion, allows the piston to increase momentum early before reaching that portion of the cylinder where pressure increases to cause the dart to discharge. This arrangement allows for a lighter launch spring and a smaller air chamber. The three-sectioned cylinder also has the advantage of greater design flexibility. Again for example, the cocking stroke for the gun or rifle is determined by the length of the dart to be discharged. However, the optimum air volume to be compressed may well be less than the cocking stroke. A designer has great flexibility in placement of structure to negate a part of the operation of the piston/cylinder so that the air volume to be compressed is just right for the launch apparatus. The three-sectioned cylinder allows for such design and structural flexibility.

Figure 26:
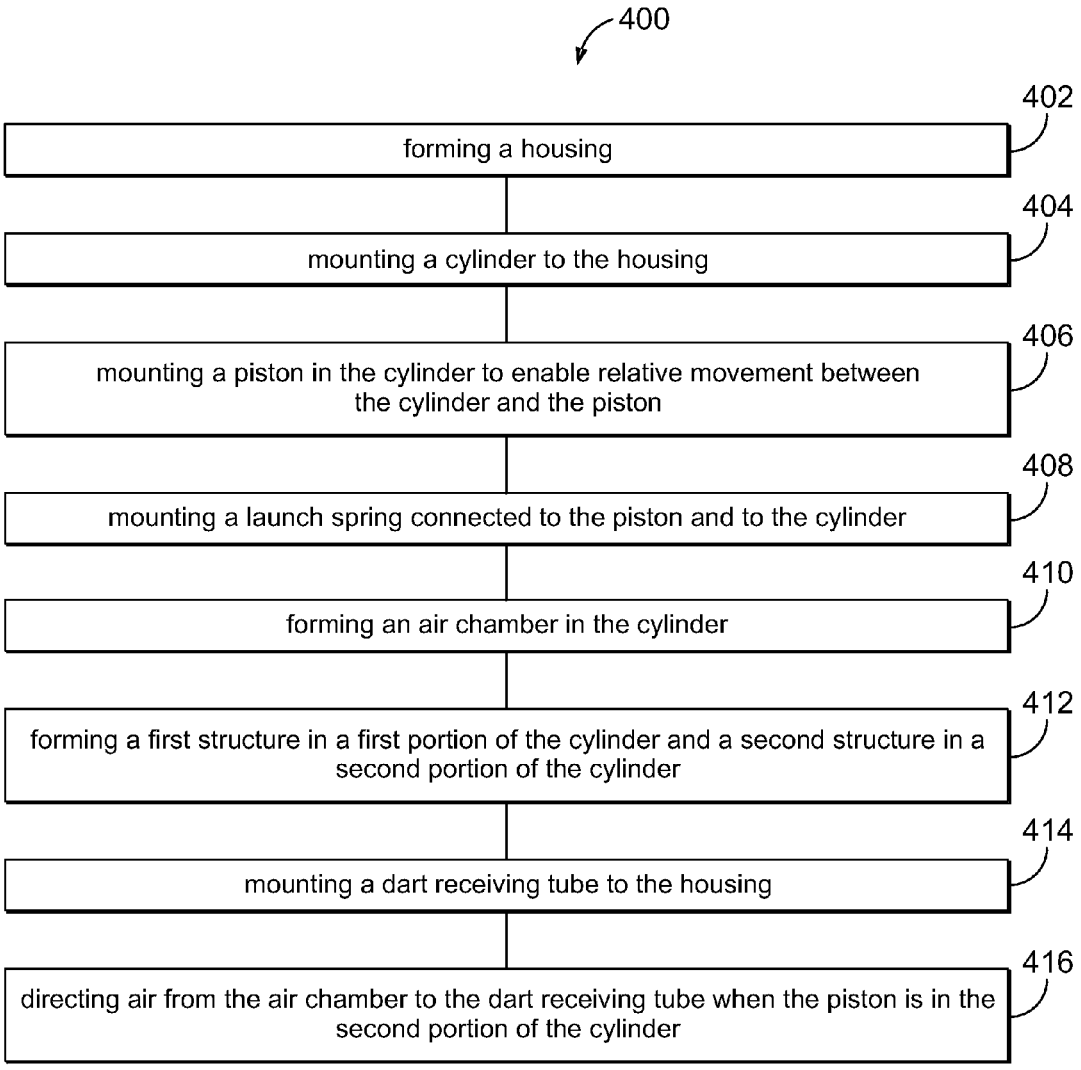
FIG. 26 is a flow diagram of a method for making a toy launch apparatus.

The present invention also includes a method 400, FIG. 26, for making a toy launch apparatus, the steps of the method including forming a housing 402, such as the housing 12 shaped like the rifle 10 or the housing 154 shaped like the gun 150, mounting a cylinder to the housing 404, such as the cylinder 30, the cylinder having the first portion 76, containing the air port slots 72, 74, and the second portion 82, such as the cylinder between the air port slots and the end of the cylinder, mounting a piston in the cylinder 406 to enable relative movement between the cylinder and the piston, mounting a launch spring 408, such as the spring 48, connected to the piston and to the cylinder for causing the relative movement of the cylinder and the piston, forming an air chamber in the cylinder 410, such as the air chamber 70, wherein the air in the air chamber is enabled to escape easily when there is relative movement between the piston and the cylinder and the piston is in the first portion of the cylinder, and pressure in the air chamber rapidly increases when there is relative movement between the piston and the cylinder and the piston is in the second portion of the cylinder. The method may also include the steps of forming a first structure in the first portion of the cylinder to enable air to escape easily and a second structure in the second portion of the cylinder to increase air pressure 412. The first structure may be the cylinder having the port slots, or the larger diameter section of the cylinder when compared to the diameter of the piston, or exhaust channels. The method may also include the steps of mounting a dart receiving tube to the housing 414, and directing air from the air chamber to the dart receiving tube 416 when the piston is in the second portion of the cylinder.

The toy launch apparatus disclosed in detail above have great play value, are fun to use and easy to operate, and are safe, even for young children, and yet the launch apparatus have robust, but simple structures, that may be produced at reasonable cost.

From the foregoing, it can be seen that there has been provided features for an improved toy launch apparatus and a disclosure of methods for making the toy. While particular embodiments of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A toy launch apparatus comprising:

a housing configured to receive one or more projectiles at the housing;

a cylinder mounted to the housing;

a piston mounted in the cylinder to enable relative movement between the cylinder and the piston;

a launch spring connected to the piston and the cylinder for causing the relative movement of the cylinder and the piston, the launch spring being movable between a cocked configuration and a relaxed configuration;

a variable volume air chamber formed in the cylinder between the cylinder and the piston, the air chamber having a predetermined first length when the launch spring is in the cocked configuration and a predetermined second length when the launch spring is in the relaxed configuration;

air escape structure in communication with the air chamber for allowing air located in the air chamber to easily escape during relative movement of the cylinder and the piston when the length of the air chamber is between the first length and a third length that is shorter than the first length and greater than the second length, wherein the air escape structure includes the cylinder having a first inner diameter when the length of the air chamber is between the first length and the third length and the air escape structure includes the cylinder having a second smaller inner diameter when the length of the air chamber is between the third length and the second length, and wherein the air escape structure enables air forward of the piston to be easily expelled during the relative movement between the cylinder and the piston when the length of the air chamber is between the first length and the third length; and an air passageway for communicating air enabling the piston to expel air from the cylinder to launch the one or more projectiles from the housing during the relative movement between the cylinder and the piston when the length of the air chamber is between the third length and the second length with rapidly increasing pressure in the second portion of the cylinder.

2. The toy launch apparatus of claim 1, including:

a dart receiving tube connected to the cylinder; and an air passageway beginning at the piston and extending to the dart receiving tube.

3. The toy launch apparatus of claim 1, wherein:

air in the air chamber is able to pass around the piston when the piston is moving in the cylinder between the first and third lengths of the air chamber.

4. The toy launch apparatus of claim 3, wherein:

air in the air chamber is unable to pass around the piston when the piston is moving in the cylinder between the third and second lengths of the air chamber.

5. The toy launch apparatus of claim 1, wherein:

the structure is configured to enable air to escape during the relative movement between the cylinder and the piston when the length of the air chamber is between the first length and the third length, while air is not allowed to escape with the structure during the relative movement between the cylinder and the piston when the length of the air chamber is between the third length and the second length.

6. The toy launch apparatus of claim 5, wherein:

the structure is configured to enable air to escape around the piston during the relative movement between the cylinder and the piston when the length of the air chamber is between the first length and the third length.

7. A method for making a toy launch apparatus, the steps of the method comprising:

forming a housing configured to receive one or more projectiles at the housing;

mounting a cylinder to the housing, the cylinder having a first portion and a second portion;

mounting a piston in the cylinder to enable relative movement between the cylinder and the piston;

mounting a launch spring connected to the piston and to the cylinder for causing the relative movement of the cylinder and the piston;

forming an air chamber in the cylinder wherein air in the air chamber is enabled to escape easily when there is relative movement between the piston and the cylinder and the piston is in the first portion of the cylinder, and air in the air chamber rapidly increases in pressure when there is relative movement between the piston and the cylinder and the piston is in the second portion of the cylinder; and forming a first structure in the first portion of the cylinder to enable air to escape easily and a second structure in the second portion of the cylinder to cause an increase in air pressure by forming the cylinder to include a greater inside diameter in the first portion of the cylinder than in the second portion of the cylinder.

8. The method of claim 7, wherein the step of mounting the cylinder includes the step of:

directing air from the air chamber to a dart receiving tube when the piston is in the second portion of the cylinder.

9. A toy launch apparatus comprising:

a housing configured to receive one or more projectiles at the housing;

a cylinder mounted to the housing, the cylinder having a first portion and a second portion;

a piston mounted in the cylinder configured to enable relative movement between the cylinder and the piston as the piston moves from the first portion to the second portion;

a structure to enable air forward of the piston in the first portion of the cylinder to be easily expelled during the relative movement between the cylinder and the piston enabling the air to escape from the first portion of the cylinder, wherein the structure comprises the first portion of the cylinder having a first diameter and the second portion of the cylinder having a second diameter, the first diameter being greater than the second diameter;

an air passageway for communicating air when the piston is in the second portion of the cylinder enabling the piston to expel air from the second portion of the cylinder during the relative movement between the cylinder and the piston in the second portion of the cylinder enabling rapidly increasing pressure in the second portion of the cylinder to launch the one or more projectiles from the housing.

10. The toy launch apparatus of claim 9, wherein:

the piston is sized such that when in the first portion the piston fits loosely allowing air to escape around the piston, and when in the second portion the piston fits snugly such that air is not allowed to escape around the piston.

11. The toy launch apparatus of claim 9, wherein:

the structure is configured to enable air to escape from the first portion of the cylinder when the piston is in the first portion, and when the piston is in the second portion air is not allowed to escape with the structure.

12. The toy launch apparatus of claim 11, wherein:

the structure is configured to enable air to escape around the piston when the piston is in the first portion, and when the piston is in the second portion air is not allowed to escape around the piston.

13. The toy launch apparatus of claim 9, comprising:

a launch spring mounted in the housing configured for causing the relative movement of the cylinder and the piston.

14. The toy launch apparatus of claim 9, wherein:

the cylinder is positioned to be stationary in the housing.

15. The toy launch apparatus of claim 14, further comprising a projectile receiving tube with the piston being connected to the projectile receiving tube and moving with the projectile receiving tube.

16. The toy launch apparatus of claim 9, further comprising an inner tube within the cylinder wherein the piston is part of the inner tube.

17. The toy launch apparatus of claim 16, wherein:

the inner tube includes the air passageway for directing air to the passageway.

18. The toy launch apparatus of claim 17, wherein:

the launch spring is positioned around the inner tube and between the inner tube and the cylinder.

* * * * *